United States Patent [19]

Klein et al.

[11] 4,190,440

[45] Feb. 26, 1980

[54] PROCESS FOR FABRICATING STEEL FROM FERROUS METAL PARTICLES

[75] Inventors: Albert J. Klein, Arlington Heights; Chiou-Tse Chen, Buffalo Grove; Lou Kohl, Palatine, all of Ill.

[73] Assignee: American Can Company, Greenwich, Conn.

[21] Appl. No.: 952,789

[22] Filed: Oct. 19, 1978

Related U.S. Application Data

[63] Continuation of Ser. No. 809,794, Jun. 24, 1977, abandoned.

[51] Int. Cl.[2] ..... B22F 3/00; B22F 1/00

[52] U.S. Cl. ..... 75/211; 75/200; 75/226; 75/224

[58] Field of Search ..... 75/200, 211, 226, 214, 75/224

[56] References Cited

U.S. PATENT DOCUMENTS 3,334,408 8/1967 Ayers ..... 75/211

*Primary Examiner*—Brooks H. Hunt

*Attorney, Agent, or Firm*—Robert P. Auber; Ira S. Dorman; George P. Ziehmer

[57] ABSTRACT

A process for conditioning ferrous particles with heat and a reducing atmosphere to reduce the oxygen content of the particles in a non-agglomerative manner and to make the conditioned particles readily pourable and free-flowing, and to process the particles into steel strip.

54 Claims, 14 Drawing Figures

PROCESS FOR FABRICATING STEEL FROM FERROUS METAL PARTICLES

This is a continuation of application Ser. No. 809,794, filed June 24, 1977, now abandoned.

BACKGROUND OF THE INVENTION

The process of this invention pertains to the conditioning of ferrous particles, and sintering and forming them into steel strip.

Although many ferrous-particle powders may have their oxide skins reduced by the techniques of this invention, the preferred particle is an as-water-atomized-ferrous-metal particle.

For clarity in describing the invention, the term "as water-atomized-ferrous-metal particles" refers to metal particles made by water atomizing and in the condition it comes out of a water atomizing apparatus without further processing or conditioning except for normal drying. That is, it has the irregular shape of as water-atomized-ferrous-metal particles with a martensitic structure, and it has whatever oxides and other impurities that occur in the as-water-atomized-ferrous-metal particles as it comes out of the water atomizing apparatus.

Agglomeration is defined herein as "any inter-particle bonding, visible to the naked eye, which persists through cooling and/or subsequent normal powder handling".

Typical techniques for making as-water atomized ferrous powder are described in United States patents of R. A. Huseby.

U.S. Pat. No. 3,325,227 for a "Method of Making Metal Powder" shows the particles have a high density and an irregular shape. Molten steel is fed by gravity in a downwardly moving stream. A plurality of flat sheets or curtains of water are impinged against the stream of molten steel at an angle greater than 5° to atomize the stream of steel into ferrous particles with iron oxide surfaces.

U.S. Pat. No. 3,309,733 for "Apparatus for Producing Metal Powder" is directed to apparatus, including an improved nozzle assembly, for practicing the process of U.S. Pat. No. 3,325,277.

U.S. Pat. No. 3,334,408 to M. D. Ayers for "Production of Powder, Strip and Other Metal from Refined Molten Metal" teaches delivery of powder to compacting rollers. The compacted strip is then sintered and delivered to another set of compacting rollers.

The shape of powder particles is important in the forming of the particles into a handleable or conveyable sheet or strip. The strip compacted from the particles must have good strength and flexibility, whereby the particles from which it is formed should be mostly particles which have an irregular shape.

Water-atomized ferrous particles, such as those made by the Huseby process, are usually irregular in shape, but if the process is not properly controlled there are a substantial quantity of rounded or spherical particles. The as-water-atomized-ferrous-metal particles have an iron core of martensite which is particularly hard, with a skin of iron oxide having a small amount of iron-alloy oxides. Martensite is a hard, non-equilibrium structure which is formed by rapid cooling of particles produced from liquid steel. For particles of similar chemical composition, those having a martensite structure with a higher hardness than other particles are preferred for the process of this invention.

There are other techniques for fabricating ferrous metal powders. The powder may be produced by an electrolytic process which tends to produce a non-martensite dendritic or tree-shaped particle.

Some powders are produced by grinding the ferrous material. Grinding produces acicular (long and narrow), angular, or fragmented shaped particles of powder.

To provide ferrous metal powder which is suitable for producing sheets or strips of steel, it was formerly thought that the powder needs to be annealed before rolling so that the powder is soft enough that it can easily be formed.

Oxygen reductions can be effected during the annealing or softening stage of powder manufacturing operations, but such reductions are effected at relatively high temperatures, above 1200° F. and usually between 1600° and 1800° F. The high temperatures are disadvantageous because at such temperatures the powder particles stick together or agglomerate. The agglomerated particles must then be cooled and tumbled, ground or comminuted, then screened before further processing.

Attention is again requested to the Ayers' U.S. Pat. No. 3,334,408, column 7, lines 53–55, wherein a reducing atmosphere is added to the powder in a holding bin. According to the patent, the reducing gas, such as hydrogen, is held by the particles for subsequent release during preheat of the powder, a process substantially different than claimed herein. See column 9, lines 17–19.

BRIEF SUMMARY OF THE INVENTION

The process of this invention preferably starts with as-water-atomized-ferrous-metal particles, preferably of irregular shape, which are then tumbled in a reducing atmosphere, preferably a hydrogen atmosphere, while simultaneously being heated at a temperature between 800° and 1200° F. for a time at temperature of at least 10 minutes to reduce substantially all of the oxygen content of iron oxides on and in the surface layer of oxides and to reduce the total oxygen content of the powder particles while producing non-agglomerated free-flowing particles whose cores are tempered martensite and whose skin is substantially pure porous iron.

Other typical reducing gases which may be used are dissociated ammonia; forty percent nitrogen, forty percent hydrogen, and twenty percent carbon monoxide; and ninety percent nitrogen, zero to five percent hydrogen, zero to five percent carbon monoxide and zero to ten percent hydrocarbon gases.

The conditioned particles preferably have a tempered martensite core structure and a surface which causes the particles to adhere together when placed in a compaction roller. The resulting green strip is sufficiently strong to carry its own weight and to be subjected to the pull of compaction rollers.

From the conditioning kiln the conditioned powder is delivered under a reducing or neutral atmosphere to compaction rolls. The delivery may be made through an insulated gravity chute which may, optionally, be heated. It may also be delivered, for example, by a spiralled screw to the compaction rolls.

Typically the temperature of the powder delivered to the compaction rolls is 200° to 300° F. cooler than the conditioning temperature.

A spreader delivers the powder into the bite of the compaction rolls so that the compacted strip is substantially constant in width and thickness.

From the compaction rolls the compacted strip is sintered under a reducing or neutral atmosphere and the strip temperature is brought up to between 1800° and 2300° F. The strip is next hot-rolled by dry (that is, not cooled by liquid) hot rolls in a reducing or neutral atmosphere to compact the strip substantially to full density and to reduce the thickness of the strip, for example, from 0.100 inch to the range of 0.010–0.020 inches.

The strip is next cooled to the range of 200°–400° F. in a reducing or neutral atmosphere. One preferred embodiment of the cooler sprays the strip with nitrogen. A more preferred embodiment of the cooler has three cooling zones. Each zone is servoed to a predetermined temperature by increasing or decreasing the atmosphere flow in that zone in response to a thermo-sensor.

After initial hot rolling, the strip may be further rolled in hot or cold rolls, trimmed, and coiled.

It is therefore an object of this invention to condition ferrous-metal particles.

It is a more precise object of this invention to condition as-water-atomized-ferrous-metal particles which reduce the oxygen content of its skin in the temperature range of 800° to 1200° F.

It is another object of this invention to render and condition as-water-atomized-ferrous-metal particles suitable for production and forming into structural shapes or parts.

It is another object of this invention to condition as-water-atomized-ferrous-metal particles to substantially reduce the total oxygen content in its skin by heating it in a hydrogen atmosphere at temperatures in a range of 800° to 1200° F. for at least 10 minutes to obtain non-agglomerated, free-flowing, conditioned, irregularly shaped ferrous particles having a low total oxygen content.

It is still another object of this invention to condition as-water-atomized-ferrous-metal particles to substantially reduce the oxygen content of its surface layer of oxides.

Another object of this invention is to apply the aforementioned methods wherein the metallurgical structure of the core of the conditioned powder particles is tempered martensite with a porous, substantially pure ferrite surface layer.

It is still another object of this invention to produce steel strip from ferrous particles.

BRIEF DESCRIPTION OF THE DRAWINGS

Other objects will become apparent from the following description, taken in combination with the accompanying drawings in which.

DETAILED DESCRIPTION OF THE INVENTION

The process of this invention conditions ferrous-metal particles to reduce the oxygen content in their surface layer and forms steel strip from those particles. Temperatures and times of conditioning are chosen to avoid agglomeration and to enhance free particle flow while still reducing the iron oxides in the skin of each particle.

The particles are conditioned at a temperature of between 800° F. and 1200° F. with an optimum temperature of approximately 1100° F. to remove substantially all of the iron oxides in the skin of the particles.

The oxides in the core of the particles are not removed and produce small inclusions in the steel which is produced from the particles.

A small quantity of the oxides, estimated at about 1% of the oxides, particularly on the larger particles, are not pure iron oxides. That is, manganese, silicon and other impurities form iron alloy oxides on the skin of the particle. These oxides can only be reduced, even in a hydrogen atmosphere, at substantially higher temperatures, i.e., above 2300° F. than the temperature of the process of this invention. Those alloyed oxides, if not removed, produce inclusions in the sheet steel which is produced from the powder.

The particles that are processed by this invention are as-water-atomized-ferrous-metal particles, but it is intended to include as-water-atomized particles with the nonpure alloyed iron oxides physically removed. No further comment will be made to distinguish between pure iron oxide as-water-atomized particles and those from which nonpure alloyed iron oxides have been removed.

Figure 2:
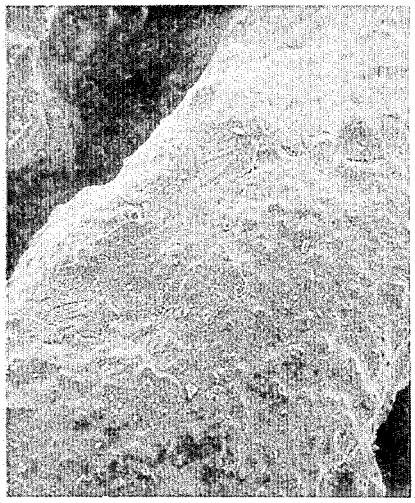
FIG. 2 is a picture of a portion of a particle of as-water-atomized-ferrous-metal, magnified 200 times.
Figure 3:
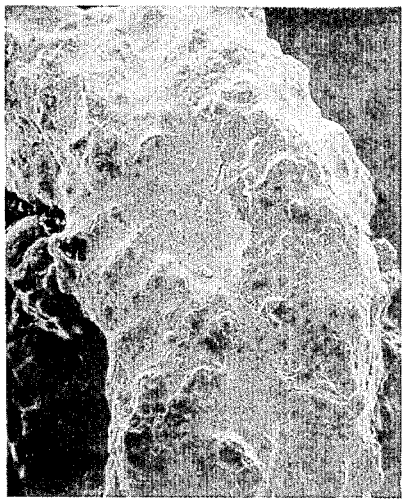
FIG. 3 is a picture of the particle of FIG. 2 after conditioning and magnified 200 times.
Figure 4:
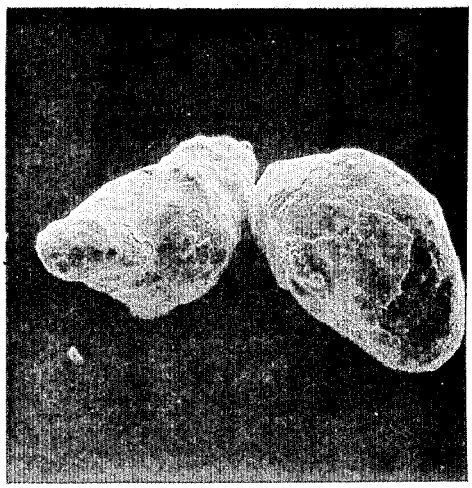
FIG. 4 is a picture of conditioned particles showing a broken skin layer of substantially pure iron.
Figure 5:
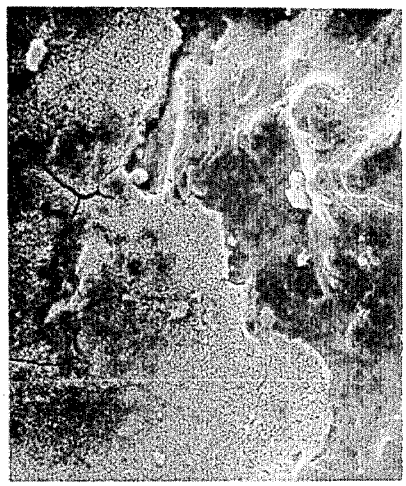
FIG. 5 is an enlarged view of a portion of a conditioned particle with pieces of the skin broken away.
Figure 6:
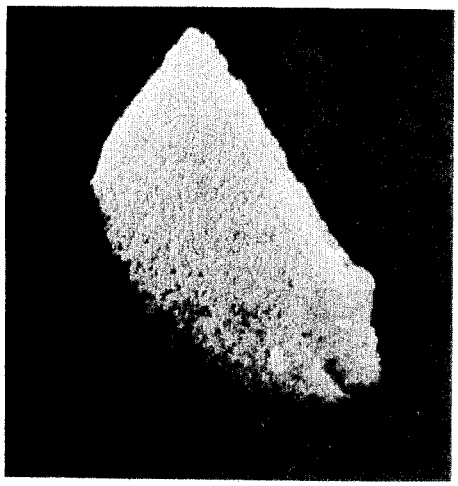
FIG. 6 is an enlarged view of a piece of substantially pure iron skin.

It is informative to examine some photographs of particle surfaces to show the effect of the process of this invention. FIG. 2 shows the surface, magnified 200X, of a typical as-water-atomized-ferrous-metal particle before processing. Only the outer surface of the oxidized skin can be seen. FIG. 3 shows the surface of a portion of such a particle, hydrogen conditioned and magnified 200 times, showing some of the iron core and a skin which is fragmented, such skin being substantially pure porous iron. In the hydrogen conditioned particles of FIG. 4, areas of porous iron conditioned skin are shown, together with the tempered martensite iron center of the particles. FIG. 5 shows a more enlarged substantially pure porous iron skin, conditioned by the process of this invention, adjacent the iron core of the particle. FIG. 6 is a picture of a piece of porous substantially pure iron skin, broken away from the core of a conditioned particle.

Figure 7:
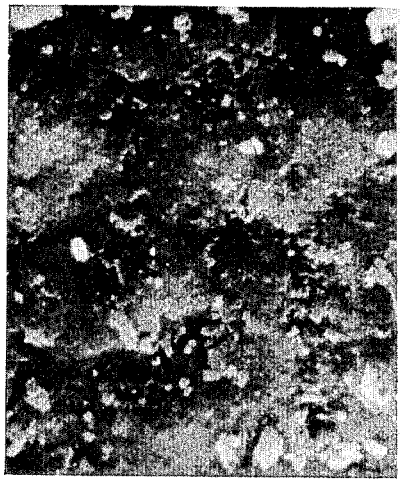
FIG. 7 is a 10,000X magnified view of the surface of an unconditioned particle.
Figure 8:
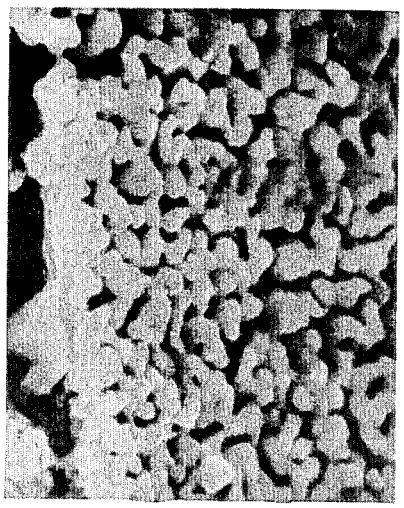
FIG. 8 is a 10,000X magnified view of the skin of a conditioned particle.

It is also instructive to examine the microscopic or fine structure of the skin. FIG. 7 shows a picture of the skin of a typical particle of as-water-atomized-ferrous-metal before conditioning in accordance with this invention. FIG. 8 shows the porous nature of the substantially pure iron skin conditioned by the process of this invention.

Notice particularly the irregular shape of the skin of FIG. 8. That irregular shape assists in the sintering process to produce a relatively strong green sheet or strip of compressed material, for the irregular surfaces readily interlock with each other.

Figure 1:
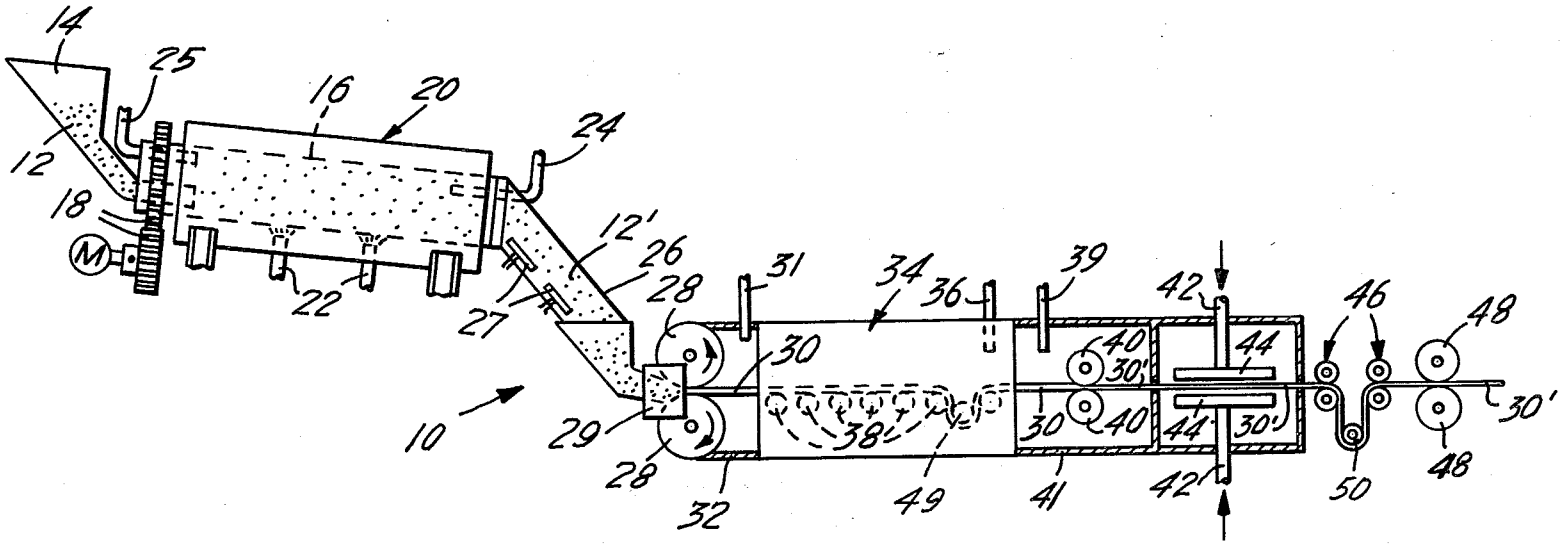
FIG. 1 is a schematic view of apparatus which is typically used to practice the method of this invention.

FIG. 1 is a schematic view of a powder-to-strip apparatus, generally designated 10, wherein ferrous-metal particles 12, in an unannealed state, are delivered to a hopper 14. Delivery may be from a storage bin (not shown) by a bucket conveyor or helical screw (examples only and not shown). The hopper 14 is connected to deliver particles to a conditioning apparatus for conditioning the particles 12 in accordance with the process of this invention.

The conditioning apparatus includes a rotatable tube 16. The tube 16 is sealed off to minimize the escape of gas from the interior thereof, and it is flooded by reducing gas, preferably hydrogen, introduced into tube 16 through pipe 24 and vented through pipe 25. It may be desirable to pre-heat the hydrogen. The tube 16 is rotated by a set of gears 18 which are driven by a motor M. Tube 16 has in the interior thereof spaced-apart flights or a continuous helical fin (not shown) mounted on its interior most wall for agitating the powder and assisting in moving the powder axially from left to right through the tube.

The rotatable tube 16 is mounted within a conditioning furnace such as kiln 20, and it is externally heated by heating means such as gas burners 22 mounted on and extending through the outer wall of kiln 20. Kiln 20 and tube 16 need not be, but preferably are pitched at an angle, typically 2 to 5 degrees, which varies depending upon the length of the tube and the heating time desired for the particles being conditioned.

The particles being conditioned are heated by the furnace jets 22 to and maintained at the desired temperature. The speed of rotation of the tube 16, its angle of tilt, the configuration of flights and the length of the tube 16 determine the length of time of heating. While the particles are heated, they are subjected to a reducing atmosphere, preferably hydrogen, whereby the skin oxides of iron are reduced leaving a skin of porous iron. The temperature maintained inside of the tube 16 by the flames of the burners 22 is within the range of 800° to 1200° F. Contact between the agitated powder and the reducing gas at such temperatures conditions the powder and effects a substantial reduction of the oxygen content in its skin. As the heated, conditioned powder 12' leaves the tube 16, it typically passes through one or more gravity chutes 26 to a compaction mechanism such as compaction rollers 28. Alternatively, for example, the powder 12' may be delivered by a helical screw (not shown). The powder is allowed to cool only a few hundreds of degrees, in chute 26, to a compaction temperature. That temperature is typically maintained by heating means such as, for example, gas burners or electrical strip heaters 27. Alternatively, the temperature may be maintained by using heavy insulation on the chute 26 or around whatever ducts through which the powder passes. Chute 26 or helical screw (not shown) also contains reducing gas to prevent reoxidizing of the particles.

The times of heating at the desired conditioning temperature is preferably at least 10 minutes. At the optimum temperature of 1100° F., most of the oxides have been removed after 10 minutes of heating at temperature, and further conditioning contributes only a small amount of removal of additional oxygen from the skin oxides. It is estimated that it typically takes five minutes in tube 16 to bring the particles up to conditioning temperature, whereby the time of travel of the particles through tube 16 is five minutes plus the conditioning time.

The conditioned powder may be pressed into molds and sintered to form conventional powder metallurgy parts.

In a preferred embodiment of the invention, the powder is continually compacted to form a continuous metal strip.

The conditioned powder is fed by a feeding means shown generally at 29 into the nip of compaction rollers 28 which roll-compact the powder into a compacted strip of high density. The compacted strip 30, referred to as a green strip, is processed in an enclosure 32 and into and through furnace 34. Furnace 34 has a controlled reducing atmosphere which is introduced through conduit 36 and exhausted through conduit 31. The compacted strip 30 is heated and sintered in furnace 34, for example, by a furnace to a hot rolling temperature between 1800° and 2400° F. to prepare the compacted strip for hot rolling. As the strip passes through furnace 34 it is supported by suitable means such as rollers 38.

Upon leaving the furnace the heated strip is delivered immediately to hot rollers generally designated at 40 which hot roll to obtain a hot roll strip 30' of full density and reduced thickness. Note that the rolls 40 are dry, and it is undesirable to cool them conventionally with water because the water would oxidize the hot strip. The strip 30' is then cooled by means such as jets of nitrogen introduced through pipes 42 between plates 44. Preferably, the cooling means has three cooling zones (not shown), and each zone is separately servoed to control the flow of the cooling nitrogen. Other neutral or reducing gases may be used to cool the strip.

The aforementioned processing steps are usually effected in a controlled reducing atmosphere, preferably hydrogen, which is introduced through respective tubes 31, 36 and 39 and maintained within the respective enclosure 32, furnace 34, and enclosure 41.

The cooled strip can be optionally passed through a pair of pinch rolls 46 to further working apparatus such as cold rollers 48 for cold rolling to desired thicknesses and to coilers and slitters (not shown) for further handling. Looper rolls or dancer rolls 49 and 50 are important to the continuous nature of the process. Whenever the continuous strip is processed through two rolling mills, such as 28 and 40, an intermediate device, such as dancer roll 49, moves up or down to take up slack in the strip. The upward and downward motion of 49 or 50 is sensed by electrical sensors (not shown) and the signal is used to servo the speed of the rollers.

A typical distribution of particles sizes in weight percent is: a trace of +20 mesh, 18% maximum between −20 and +40 mesh, 22% ±3% between −40 and +60 mesh, 17% ±2% between −60 and +80 mesh, 10% ±2% between −80 and +100 mesh, 11% ±2% between −100 and +140 mesh, 13% ±2% between −140 and +230 mesh, and 16% maximum of −230 mesh.

The particles are preferably substantially martensite of primarily irregular shape, although they are occasionally of a mixed martensite-ferrite structure with a primarily irregular shape. A typical chemical composition of a powder as-received and before processing is:

| Element | Weight Percent |
|---|---|
| O | 1.5% maximum |
| C | 0.006% to 0.20% |
| Si | 0.02% maximum |
| Mn | 0.05% to 0.30% |
| P | 0.015% maximum |
| S | 0.02% maximum |

It must be noted, however, that even with initial oxygen content higher than the preferred specification above, and with the size distribution outside of the above specification, the conditioning process of this invention still substantially reduces the amount of iron oxide in the skin of each particle.

Figure 9:
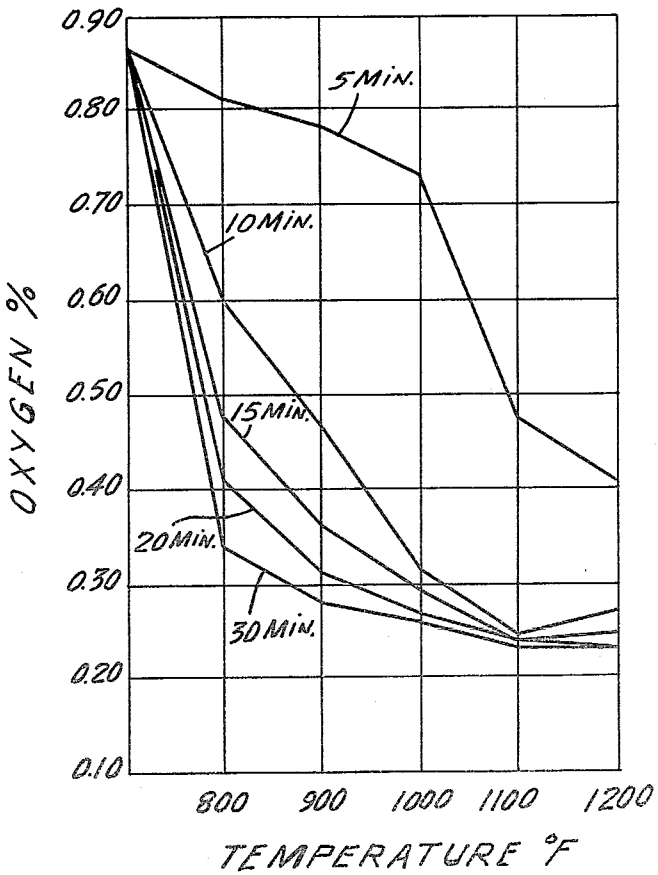
FIG. 9 is a graph of the percentage of oxygen in a particle from a first lot, made by a first manufacturer, plotted against temperature of conditioning in hydrogen.
Figure 10:
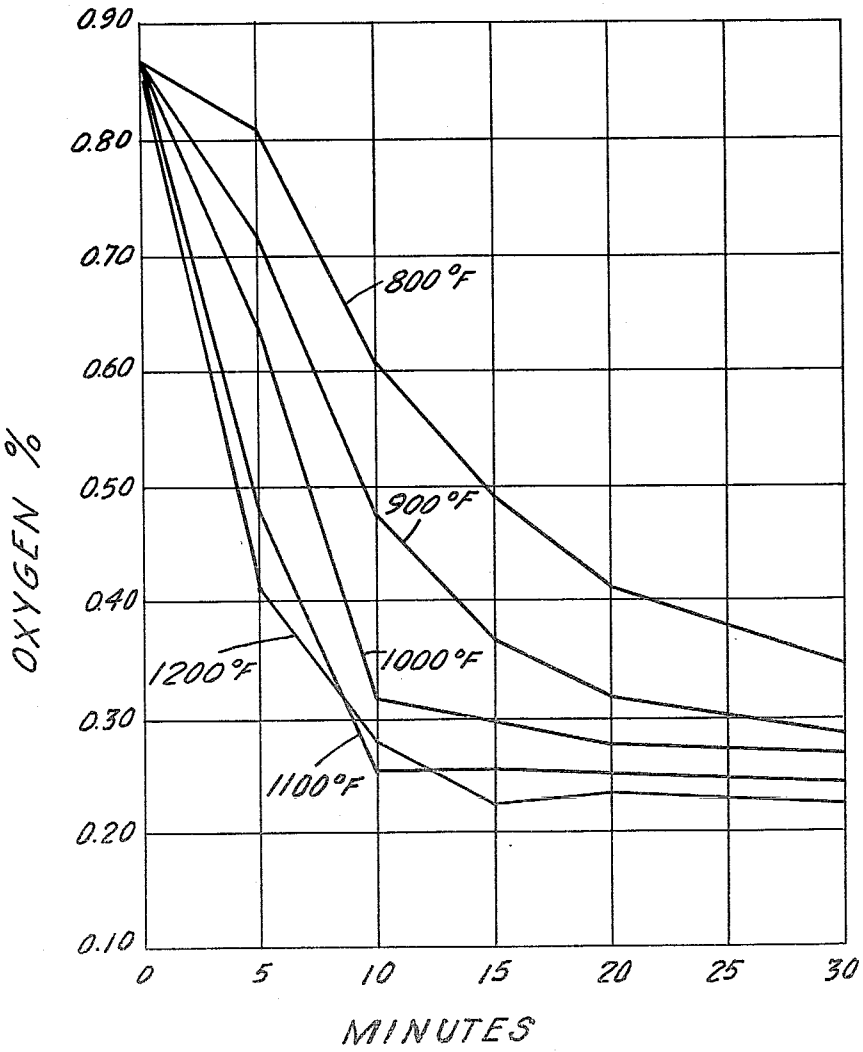
FIG. 10 is a graph of the percentage of oxygen in the lot of FIG. 9 plotted against time at temperature in hydrogen.
Figure 11:
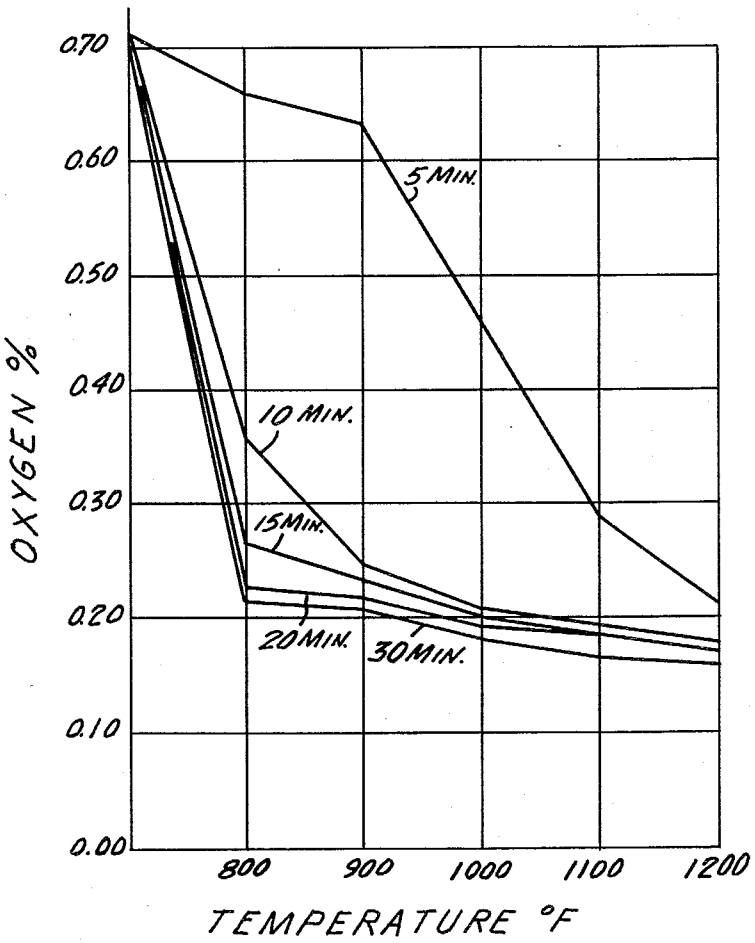
FIG. 11 is a graph of the percentage of oxygen in a particle from a second lot, made by a second manufacturer, plotted against temperature of conditioning in hydrogen.

FIGS. 9 through 11 are graphs showing oxygen reduction by the process of this invention for three different lots of ferrous metal particles received from three different manufacturers.

The data for the curves was obtained by placing a 70 gm. sample of particles into a closed, 36 inches × 64 mm tube, then flowing hydrogen through the tube while heating it in a furnace. The tube was rotated, while heating, about its major axis at four RPM. Five minutes was allowed to bring the particles up to furnace temperature. In larger tubes with larger amounts of particles, additional time or heat, or both, would be needed to bring the particles up to temperature.

To ensure control on the reduction process, the tube is first purged of air by using nitrogen gas. The nitrogen is then purged by hydrogen. During cooling, the hydrogen atmosphere was maintained. The hydrogen was then flushed out by nitrogen.

Each of the lots of particles was conditioned at temperatures of 800° F., 900° F., 1000° F., 1100° F., 1200° F., and 1300° F. It was found that the powder just began to agglomerate at 1200° F., and a temperature of 1300° F. is not useful. The data above 1200° F. is not plotted in FIGS. 9 through 14. The powder was at room temperature when placed into the conditioning process. Five minutes was allowed to bring the particles to temperature. After being agitated and heated at temperature in a flood of hydrogen reducing atmosphere for 5 minutes, 10 minutes, 15 minutes, 20 minutes and 30 minutes, the conditioned powder was analyzed, and the amount of remaining oxygen in the sample was determined.

Figure 13:
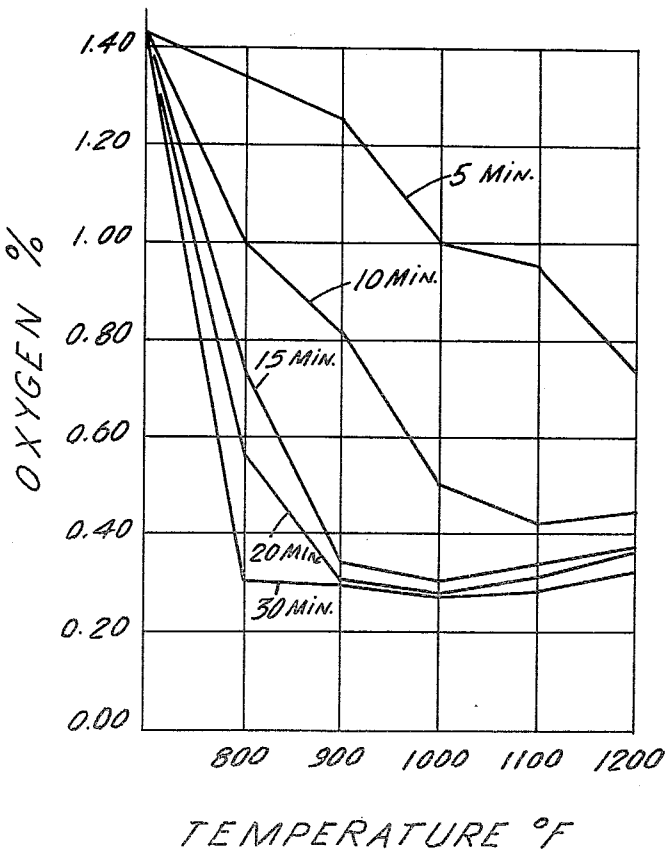
FIG. 13 is a graph of the percentage of oxygen in a particle from a third lot, made by a third manufacturer, plotted against temperature of conditioning in hydrogen.

FIGS. 9, 11 and 13 are graphs of oxygen content for various times at temperatures, plotted against the conditioning temperature, for lots 1, 2 and 3 of particles, respectively.

Figure 12:
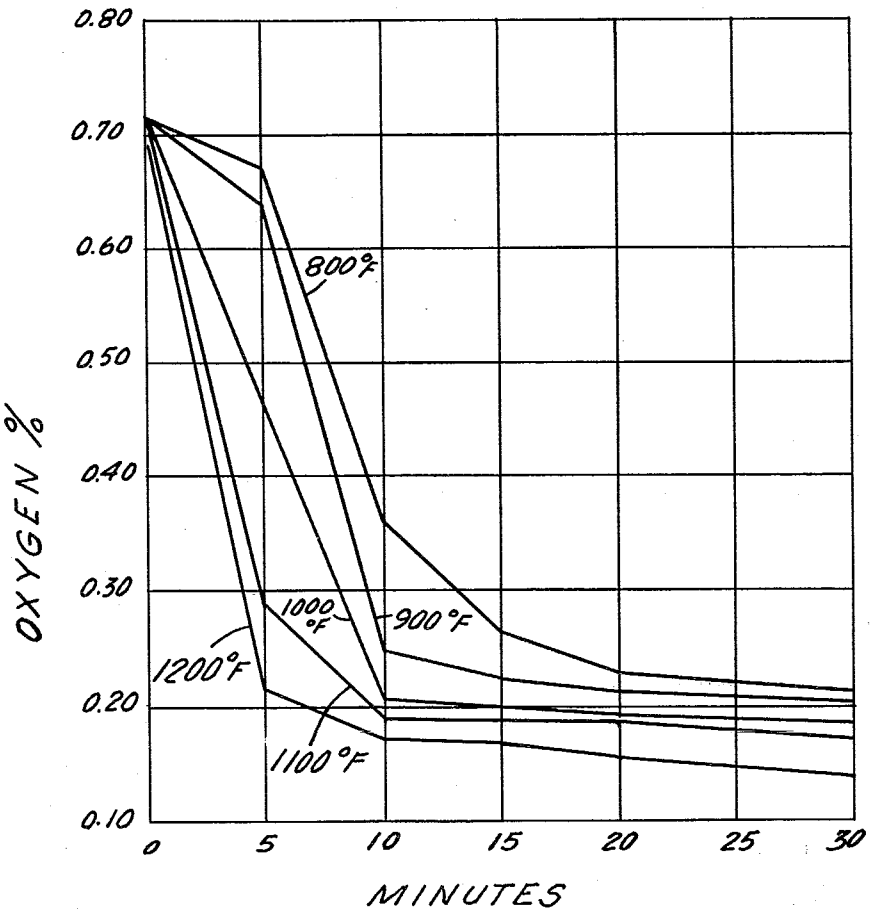
FIG. 12 is a graph of the percentage of oxygen in the lot of FIG. 11 plotted against time at temperature in hydrogen.
Figure 14:
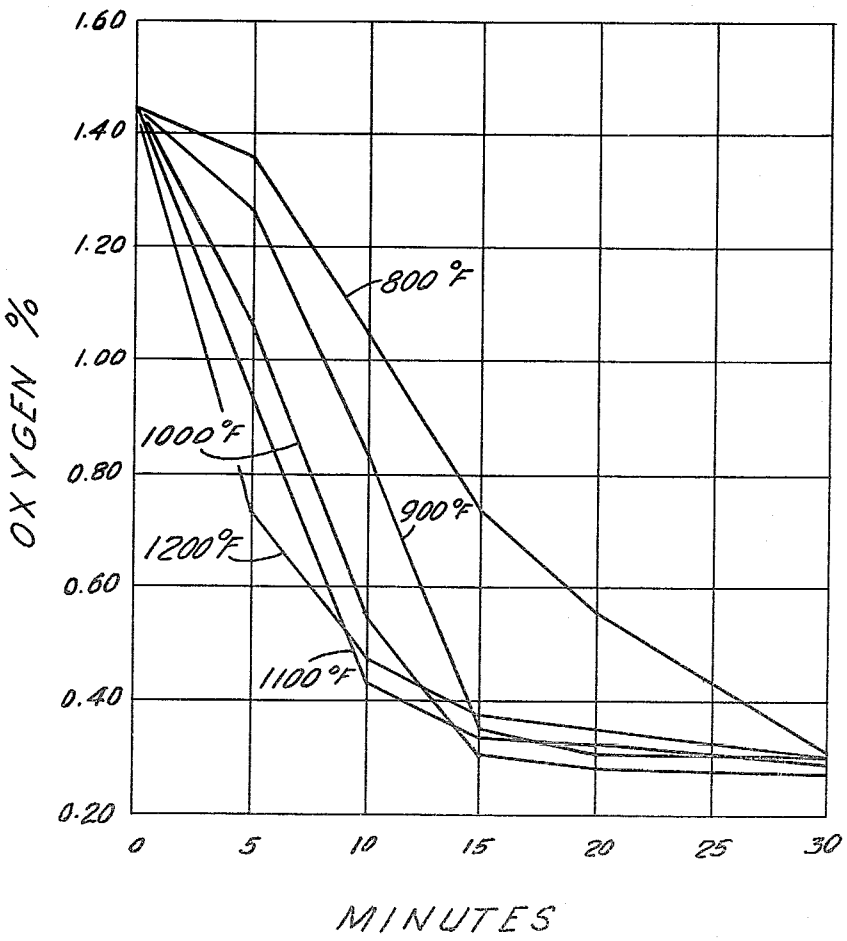
FIG. 14 is a graph of the percentage of oxygen in the lot of FIG. 13 plotted against time at temperature in hydrogen.

FIGS. 10, 12 and 14 are graphs of oxygen content for various conditioning temperatures, plotted against the time at temperature, for lots 1, 2 and 3 of particles, respectively.

In FIGS. 9–14, where the curves flatten out, substantially all of the reducible oxygen for the particular temperature or time at temperature has occurred.

In FIGS. 9, 11 and 13 the five minute curve does not flatten out within the temperature range of 800° to 1200° F. The oxygen content is reduced. It may be reduced enough for a particular steel product, but a higher temperature would be required before the curve would flatten. Such higher temperature would cause the particles to agglomerate—which is not acceptable.

FIGS. 9, 11 and 13 show that after ten minutes at temperature (plus five minutes for heating to temperature), the curves flatten above 1000° F. In the second lot, for FIG. 11, the curve flattens above 900° F. It may safely be said that substantially all of the reducible oxides which may be reduced in ten minutes at temperature (plus five minutes for heating to temperature) are reduced with processing temperatures between 1000° and 1200° F.

After fifteen minutes at temperature (plus five minutes for heating to temperature), the curves flatten above 900° F. In the second lot, for FIG. 11, the curve is reasonably flat above 800° F. It may safely be said that substantially all of the reducible oxides which may be reduced in fifteen minutes at temperature (plus five minutes for heating to temperature) are reduced with processing temperatures between 900° and 1200° F.

After twenty minutes at temperature (plus five minutes for heating to temperature), the curves flatten above 900° F. In the second lot, for FIG. 11, the curve is reasonably flat above 800° F. It may safely be said that substantially all of the reducible oxides which may be reduced in fifteen minutes at temperature (plus five minutes for heating to temperature) are reduced with processing temperatures between 900° and 1200° F.

After thirty minutes at temperature (plus five minutes for heating to temperature), the curves flatten above 800° F. It may safely be said that substantially all of the reducible oxides which may be reduced in fifteen minutes at temperature (plus five minutes for heating to temperature) are reduced with processing temperatures between 800° and 1200° F.

The optimum temperature is chosen at 1100° F. because the curves have substantially flattened at that temperature, and it is substantially below the 1200° F. temperature where agglomeration starts.

In FIGS. 10, 12 and 14, the 800° F. curve starts to flatten after thirty minutes of conditioning at temperature. In FIG. 10 the curve starts to flatten after twenty minutes at temperature. In FIG. 12 the curve starts to flatten after fifteen minutes at temperature. That is, substantially all of the reducible oxides which may be reduced at 800° F. are reduced after at least thirty minutes conditioning at temperature, plus five minutes to bring the particles up to temperature.

The 900° F. curve flattens after fifteen minutes of conditioning at temperature. In FIG. 12 the curve flattens after ten minutes of conditioning at temperature. Substantially all of the reducible oxides which may be reduced at 900° F. are reduced after at least fifteen minutes of conditioning at temperature, plus five minutes to bring the particles up to temperature.

The 1000° F. curve flattens after fifteen minutes of conditioning at temperature. In FIGS. 10 and 12 the curve flattens after ten minutes of conditioning at temperature. Substantially all of the reducible oxides which may be reduced at 1000° F. are reduced after at least fifteen minutes of conditioning at temperature, plus five minutes to bring the particles up to temperature.

The 1100° F. curve flattens after ten minutes of conditioning at temperature. That is, substantially all of the reducible oxides which may be reduced at 1100° F. are reduced after at least ten minutes of conditioning at temperature, plus five minutes to bring the particles up to temperature.

The 1200° F. curve flattens after ten minutes of conditioning at temperature. In FIG. 12 the curve flattens after five minutes of conditioning at temperature. Substantially all of the reducible oxides which may be reduced at 1200° F. are reduced after at least ten minutes of conditioning at temperature, plus ten minutes to bring the particles up to temperature.

The optimum time of conditioning at temperature appears from the curves to be at least twenty minutes.

The metallurgical structure of the core of the as-received particles is preferably martensite, a hard, non-equilibrium structure formed by rapid cooling of powder particles which are produced from liquid steel. Given powder particles of similar chemical composition, those having a martensite structure have higher hardness than annealed powders. In the past it has been considered necessary to anneal the powders to make the cores sufficiently soft to form a steel strip. The martensite structure of the particle subjected to the temperature conditioning parameters of this invention, from 800° to 1200° F. does change to a tempered, i.e. softened about 50%, martensite structure.

The powder of FIGS. 13 and 14 is not pure martensite, but part ferrite. The curves thus demonstrate that the process of this invention is effective on non-martensite particle structure.

When ferrite particles are annealed they are in the 1800° F. range. They remain ferrite until about 1400° F. at which temperature they begin to transform into an austenite structure.

The process of this invention, however, never exceeds 1200° F. because the particles tend to agglomerate at that and higher temperatures.

The particle size distribution range of the powder used in the process of this invention is one in which the particles are substantially free flowing while they are being agitated and heated in a substantially pure hydrogen reducing atmosphere at a temperature from 800° F. to 1200° F. for at least 10 minutes.

"Substantially free flowing" means that with agitation, provided for example by means such as rotatable tube 16, the powder particles neither agglomerate nor temporarily stick to each other or to the interior of the tube, and their movement relative to each other is not significantly restricted. The free floating condition of the powder during agitation allows maximum exposure of powder particles to the reducing atmosphere and maximum or substantial reduction of the total oxygen content of the reducible oxides on and in the surface or skin of the powder particles.

"Substantially free flowing" also means that upon leaving tube 16, or after conditioning the conditioned powder can be efficiently and effectively fed in a controlled, unsaturated manner directly to a compaction mechanism such as rollers 28 without any need for special prefeeding or pre-communition which would otherwise be needed to separate or break up aggregated, agglomerated, stuck together or adhered particles.

The conditioning steps of this invention not only condition the powder, but also vaporize volatile contaminants on the powder particles such as hydrocarbons: minor amounts of oil and grease.

It is also important that substantially all water be removed by the flowing hydrogen after release from the particles. Note that the powder particles, during conditioning, use at least 0.17 cubic feet of hydrogen per pound of powder. The flow rate in a rotary kiln whose tube is 30 feet long and has an inside diameter of 4 feet typically uses a hydrogen flow rate of from 2 to 8, and preferably 2 to 5 cubic feet per hour per pound of powder. The flow is adequate to sweep out all of the produced water vapor. The hydrogen ratio required is proportional to the quantity of oxide to be reduced.

Other typical reducing gases which may be used are dissociated ammonia; forty percent nitrogen, forty percent hydrogen, and twenty percent carbon monoxide; and five percent carbon monoxide and zero to ten percent hydrocarbon gases. These gases have an advantage that they produce less water vapor, and they are cheaper than hydrogen.

Thus, the process of this invention conditions ferrous-metal particles which have a surface layer of iron oxide thereon to substantially reduce the oxygen content of the iron oxide in or on the surface layer and to obtain a free flowing, non-agglomerated conditioned ferrous powder whose total oxygen content is substantially reduced. Further above-described process steps then convert the particles into high density steel by compacting, sintering and rolling.

Although the invention has been described in detail above, it is not intended that the invention should be limited by that description but only in accordance with that description taken together with the appended claims.

We claim:

1. A process for producing steel strip comprising:

(a) providing as-water-atomized ferrous metal powder whose particles have a martensitic structure, a surface layer of mostly iron oxide thereon, a particle size distribution range which includes no more than traces of about 20 mesh, no more than about 16 weight percent smaller than 230 mesh and the balance between 20 and 230 mesh and a total oxygen content of up to about 1.5 weight percent;

(b) heating said particles at a temperature between about 900° and 1200° F. for a conditioning period of at least about 10 but no longer than about 30 minutes while simultaneously agitating said particles and continuously flooding them with a controlled reducing atmosphere in sufficient volume to maintain the reducing action throughout said conditioning period to dry the powder particles and to substantially reduce the oxygen content of reducible iron oxides in the surface layer and to reduce the total oxygen content of the powder particles to less than about 0.30 weight percent, thereby obtaining free-flowing, substantially non-agglomerated, un-annealed conditioned, ferrous powder particles having a tempered martensitic structure and a porous, substantially pure ferrite layer thereon;

(c) compacting said heated particles in a controlled reducing or neutral atmosphere to produce a hot compacted strip;

(d) further heating said compacted strip in a controlled reducing or neutral atmosphere to between 1800°-2400° F.;

(e) hot-rolling said heated compacted strip in a controlled neutral or reducing atmosphere; and (f) cooling said hot-rolled strip to between 200°-400° F. in a controlled reducing or neutral atmosphere.

2. The method of claim 1 and further comprising cold rolling said cooled strip.

3. The method of claim 2 and further comprising trimming said cold rolled strip.

4. The method of claim 3 and further comprising coiling said trimmed strip.

5. The method of claim 1 in which said controlled atmosphere is a controlled reducing atmosphere.

6. The method of claim 5 in which said controlled reducing atmosphere is chosen from the group consisting of substantially pure hydrogen; substantially dissociated ammonia; a mixture of substantially forty percent nitrogen, substantially forty percent hydrogen and substantially twenty percent carbon monoxide; and a mixture of substantially ninety percent nitrogen, zero to five percent hydrogen, zero to five percent carbon monoxide and zero to ten percent hydrocarbon gases.

7. The method of claim 1 in which said controlled atmosphere is a gas which has substantially no chemical reaction with steel.

8. The method of claim 1 in which said controlled atmosphere for cooling is nitrogen.

9. The method of claim 1 wherein said reducing atmosphere is substantially pure hydrogen.

10. The method of claim 1 wherein said reducing atmosphere is substantially dissociated ammonia.

11. The method of claim 1 wherein said reducing atmosphere is a mixture of substantially forty percent nitrogen, substantially forty percent hydrogen, and substantially twenty percent carbon monoxide.

12. The method of claim 1 wherein said reducing atmosphere is a mixture of substantially ninety percent nitrogen, zero to five percent hydrogen, zero to five percent carbon monoxide and zero to ten percent hydrocarbon gases.

13. The method of claim 1 wherein the time period at temperature of said particles is at least 10 minutes and the processing temperature of said particles is between 1000° and 1200° F.

14. The method of claim 1 wherein the time period at temperature of said particles is at least 15 minutes, and the processing temperature of said particles is between 900° and 1200° F.

15. The method of claim 1 wherein the time period at temperature of said particles is at least 20 minutes and the processing temperature of said particles is between 900° and 1200° F.

16. The method of claim 1 wherein the time period at temperature of said particles is at least 30 minutes and the processing temperature of said particles is between 900° and 1200° F.

17. The method of claim 1 wherein the processing temperature of said particles is substantially 1100° F.

18. The method of claim 1 wherein the temperature of said particles is substantially 900° F., and the time period at temperature of said particles is at least 30 minutes.

19. The method of claim 1 wherein the processing temperature of said particles is substantially 900° F. and the time period at temperature of said particles is at least 15 minutes.

20. The method of claim 1 wherein the processing temperature of said particles is substantially 1000°F. and the time period at temperature of said particles is at least 15 minutes.

21. The method of claim 1 wherein the processing temperature of said particles is 1100° F., and the time period at temperature is at least 10 minutes.

22. The method of claim 1 wherein the processing temperature of said particles is substantially 1200° F., and the time period at temperature is at least 10 minutes.

23. The method of claim 1 wherein the time period at temperature of said particles is at least 20 minutes.

24. The method of claim 1 wherein the structure of most of the core of said particles is martensite.

25. The method of claim 1 wherein said particles are as-water-atomized-ferrous-metal particles.

26. The method of claim 1 wherein the size distribution of said particles are substantially as follows:

| % By Weight | Mesh |
|---|---|
| Trace | +20 mesh |
| 18% maximum | −20 and +40 mesh |
| 22% ± 3% | −40 and +60 mesh |
| 17% ± 2% | −60 and +80 mesh |
| 10% ± 2% | −80 and +100 mesh |
| 11% ± 2% | −100 and +140 mesh |
| 13% ± 2% | −140 and +230 mesh |
| 16% maximum | −230 mesh |

27. The method of claim 1 wherein the chemical composition of said particles are substantially as follows:

| Element | Weight Percent |
|---|---|
| O | 1.50% maximum |
| C | 0.006% to 0.20% |
| Si | 0.02% maximum |
| Mn | 0.05% to 0.30% |
| P | 0.015% maximum |

28. The method of claim 1 in which said hot-rolling is dry hot-rolling.

29. The method of claim 28 and further comprising cold rolling said cooled strip.

30. The method of claim 29 and further comprising trimming said cold rolled strip.

31. The method of claim 30 and further comprising coiling said trimmed strip.

32. The method of claim 28 in which said controlled atmosphere is a controlled reducing atmosphere.

33. The method of claim 32 in which said controlled reducing atmosphere are chosen from the group consisting of substantially pure hydrogen; substantially dissociated ammonia; a mixture of substantially forty percent nitrogen, substantially forty percent hydrogen and substantially twenty percent carbon monoxide; and a mixture of substantially ninety percent nitrogen, zero to five percent hydrogen, zero to five percent carbon monoxide and zero to ten percent hydrocarbon gases.

34. The method of claim 28 in which said controlled atmosphere is a gas which has substantially no chemical reaction with steel.

35. The method of claim 28 in which said controlled atmosphere is nitrogen.

36. The method of claim 28 wherein said reducing atmosphere is substantially pure hydrogen.

37. The method of claim 28 wherein said reducing atmosphere is substantially dissociated ammonia.

38. The method of claim 28 wherein said reducing atmosphere is a mixture of substantially forty percent nitrogen, substantially forty percent hydrogen, and substantially twenty percent carbon monoxide.

39. The method of claim 28 wherein said reducing atmosphere is a mixture of substantially ninety percent nitrogen, zero to five percent hydrogen, zero to five percent carbon monoxide and zero to ten percent hydrocarbon gases.

40. The method of claim 28 wherein the time period at temperature of said particles is at least 10 minutes and the processing temperature of said particles is between 1000° and 1200° F.

41. The method of claim 28 wherein the time period at temperature of said particles is at least 15 minutes, and the processing temperature of said particles is between 900° and 1200° F.

42. The method of claim 28 wherein the time period at temperature of said particles is at least 20 minutes and the processing temperature of said particles is between 900° and 1200° F.

43. The method of claim 28 wherein the time period at temperature of said particles is at least 30 minutes and the processing temperature of said particles is between 900° and 1200° F.

44. The method of claim 28 wherein the processing temperature of said particles is substantially 1100° F.

45. The method of claim 28 wherein the temperature of said particles is substantially 900° F., and the time period at temperature of said particles is at least 30 minutes.

46. The method of claim 28 wherein the processing temperature of said particles is substantially 900° F. and the time period at temperature of said particles is at least 15 minutes.

47. The method of claim 28 wherein the processing temperature of said particles is substantially 1000° F. and the time period at temperature of said particles is at least 15 minutes.

48. The method of claim 28 wherein the processing temperature of said particles is 1100° F., and the time period at temperature is at least 10 minutes.

49. The method of claim 28 wherein the processing temperature of said particles is substantially 1200° F., and the time period at temperature is at least 10 minutes.

50. The method of claim 28 wherein the time period at temperature of said particles is at least 20 minutes.

51. The method of claim 28 wherein the structure of most of the core of said particles is martensite.

52. The method of claim 28 wherein said particles are as-water-atomized-ferrous-metal particles.

53. The method of claim 28 wherein the size distribution of said particles are substantially as follows:

| % By Weight | Mesh |
|---|---|
| Trace | +20 mesh |
| 18% maximum | −20 and +40 mesh |
| 22% ± 3% | −40 and +60 mesh |
| 17% ± 2% | −60 and +80 mesh |
| 10% ± 2% | −80 and +100 mesh |
| 11% ± 2% | −100 and +140 mesh |
| 13% ± 2% | −140 and +230 mesh |
| 16% maximum | −230 mesh |

54. The method of claim 28 wherein the chemical composition of said particles are substantially as follows:

| Element | Weight Percent |
|---|---|
| O | 1.50% maximum |
| C | 0.006% to 0.20% |
| Si | 0.02% maximum |
| Mn | 0.05% to 0.30% |
| P | 0.015% maximum |

* * * * *